US011040842B2

(12) United States Patent
Hyodo et al.

(10) Patent No.: US 11,040,842 B2
(45) Date of Patent: Jun. 22, 2021

(54) SHEET SUPPORTING APPARATUS AND IMAGE FORMING APPARATUS

(71) Applicant: CANON KABUSHIKI KAISHA, Tokyo (JP)

(72) Inventors: Taisuke Hyodo, Susono (JP); Masaki Iwase, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/266,463

(22) Filed: Feb. 4, 2019

(65) Prior Publication Data

US 2019/0168977 A1 Jun. 6, 2019

Related U.S. Application Data

(63) Continuation of application No. 15/658,664, filed on Jul. 25, 2017, now Pat. No. 10,227,191.

(30) Foreign Application Priority Data

Aug. 2, 2016 (JP) ..... 2016-152178

(51) Int. Cl.
*B65H 1/26* (2006.01)
*G03G 15/00* (2006.01)
(Continued)

(52) U.S. Cl.
CPC ..... *B65H 1/04* (2013.01); *B65H 1/266* (2013.01); *G03G 15/6502* (2013.01);
(Continued)

(58) Field of Classification Search
CPC .. B65H 2402/64; B65H 1/04; B65H 2511/10; B65H 2405/00; B65H 2405/114; B65H 1/266; G03G 15/6502
(Continued)

(56) References Cited

U.S. PATENT DOCUMENTS 7,694,958 B2 * 4/2010 Nakamura ..... G03G 15/6502 271/145
8,045,216 B2 10/2011 Kobayashi
(Continued)

FOREIGN PATENT DOCUMENTS

JP 05-278869 A 10/1993
JP 09-071328 A 3/1997
(Continued)

OTHER PUBLICATIONS

Japanese Office Action dated Jul. 14, 2020, in related Japanese Patent Application No. 2016-152178.

*Primary Examiner* — Patrick Cicchino
(74) *Attorney, Agent, or Firm* — Venable LLP

(57) ABSTRACT

A sheet supporting apparatus includes a cassette body supporting a sheet, a regulation device disposed on the cassette body in a moving direction and regulating a position of an edge of the sheet, and a plurality of engaged portions disposed on the cassette body. The regulation device includes a body portion, an engaging portion moving between an engagement position at which the engaging portion engages with one of the engaged portions and a separation position at which the engaging portion is separated from the engaged portions, an operation member pivotably supported on the body portion and operated between a first posture at which the operation member positions the engaging portion at the engagement position and a second posture at which the operation member positions the engaging portion at the separation position, and a retention portion retaining the operation member at the first posture.

10 Claims, 8 Drawing Sheets

(51) Int. Cl.
*B65H 1/04* (2006.01)
*B41J 13/10* (2006.01)

(52) U.S. Cl.
CPC ..... *B41J 13/103* (2013.01); *B65H 2402/514* (2013.01); *B65H 2402/5151* (2013.01); *B65H 2402/64* (2013.01); *B65H 2403/533* (2013.01); *B65H 2405/00* (2013.01); *B65H 2405/114* (2013.01); *B65H 2511/10* (2013.01); *B65H 2511/11* (2013.01); *B65H 2511/20* (2013.01)

(58) Field of Classification Search
USPC ..... 271/171
See application file for complete search history.

(56) References Cited

U.S. PATENT DOCUMENTS

| | | | | |
|---|---|---|---|---|
| 8,622,383 | B2 * | 1/2014 | Lee | B65H 1/266 271/171 |
| 9,260,262 | B2 * | 2/2016 | Matsumoto | B65H 1/266 |
| 9,382,083 | B2 | 7/2016 | Hyodo | |
| 9,796,551 | B2 * | 10/2017 | Hoshi | B65H 1/04 |
| 9,938,095 | B2 * | 4/2018 | Kaiga | B65H 1/266 |
| 9,957,122 | B2 * | 5/2018 | Koga | B65H 1/04 |
| 10,479,627 | B2 * | 11/2019 | Ishida | B65H 1/266 |
| 2011/0058883 | A1 * | 3/2011 | Kim | B65H 1/266 400/613 |
| 2015/0203311 | A1 * | 7/2015 | Matsumoto | B65H 1/266 271/241 |
| 2015/0298921 | A1 * | 10/2015 | Ishikura | B65H 1/04 271/264 |

FOREIGN PATENT DOCUMENTS

| | | | |
|---|---|---|---|
| JP | 10-231029 | A | 9/1998 |
| JP | 2007-223686 | A | 9/2007 |
| JP | 2008-105856 | A | 5/2008 |
| JP | 2011-016640 | A | 1/2011 |
| JP | 2015-155351 | A | 8/2015 |

* cited by examiner

SHEET SUPPORTING APPARATUS AND IMAGE FORMING APPARATUS

This application is a continuation of application Ser. No. 15/658,664, filed Jul. 25, 2017.

BACKGROUND OF THE INVENTION

Field of the Invention

The present invention relates to a sheet supporting apparatus for supporting sheets and an image forming apparatus including the sheet supporting apparatus.

Description of the Related Art

In general, image forming apparatuses, such as copying machines and printers, are provided with a sheet feeding cassette that stores sheets used to form images. Positions of the trailing edge and the side edges of the sheets, stored in the sheet feeding cassette, are regulated by regulation plates, which are supported such that the regulation plate can be moved with respect to the sheet feeding cassette. A user moves the regulation plate in accordance with a sheet size, sets sheets in the sheet feeding cassette, and attaches the sheet feeding cassette to an apparatus body.

Conventionally, Japanese Patent Application Publication No. H05-278869 proposes a sheet feeding cassette in which projections are formed at two corner portions of a regulation plate, and concave portions capable of engaging with one of the projections are formed in a cassette body. A user can move the regulation plate by turning the regulation plate to one direction to release the engagement between the one of the projections and one of the concave portions, and position the regulation plate by releasing the turn of the regulation plate to engage the one of the projections with another one of the concave portions.

In the sheet feeding cassette described in Japanese Patent Application Publication No. H05-278869, however, because the engagement between the projection and the concave portion may not be ensured or a user may perform a wrong operation, the regulation plate may be displaced from a proper position. The displacement of the regulation plate from the proper position causes reduction in print precision and occurrence of jam.

SUMMARY OF THE INVENTION

According to one aspect of the present invention, a sheet supporting apparatus includes a supporting portion configured to support a sheet, and a regulation unit configured to regulate a position of an edge of the sheet supported by the supporting portion, the regulation unit configured to be moved and positioned with respect to the supporting portion. The regulation unit includes a body portion, an engagement portion supported by the body portion, and configured to move between an engagement position at which the engagement portion engages with the supporting portion and a separation position at which the engagement portion is separated away from the supporting portion, and a regulation portion configured to position the engagement portion with respect to the body portion such that the engagement portion is retained at the engagement position.

Further features of the present invention will become apparent from the following description of exemplary embodiments with reference to the attached drawings.

DESCRIPTION OF THE EMBODIMENTS

First Embodiment

Overall Structure of Printer

Figure 1:
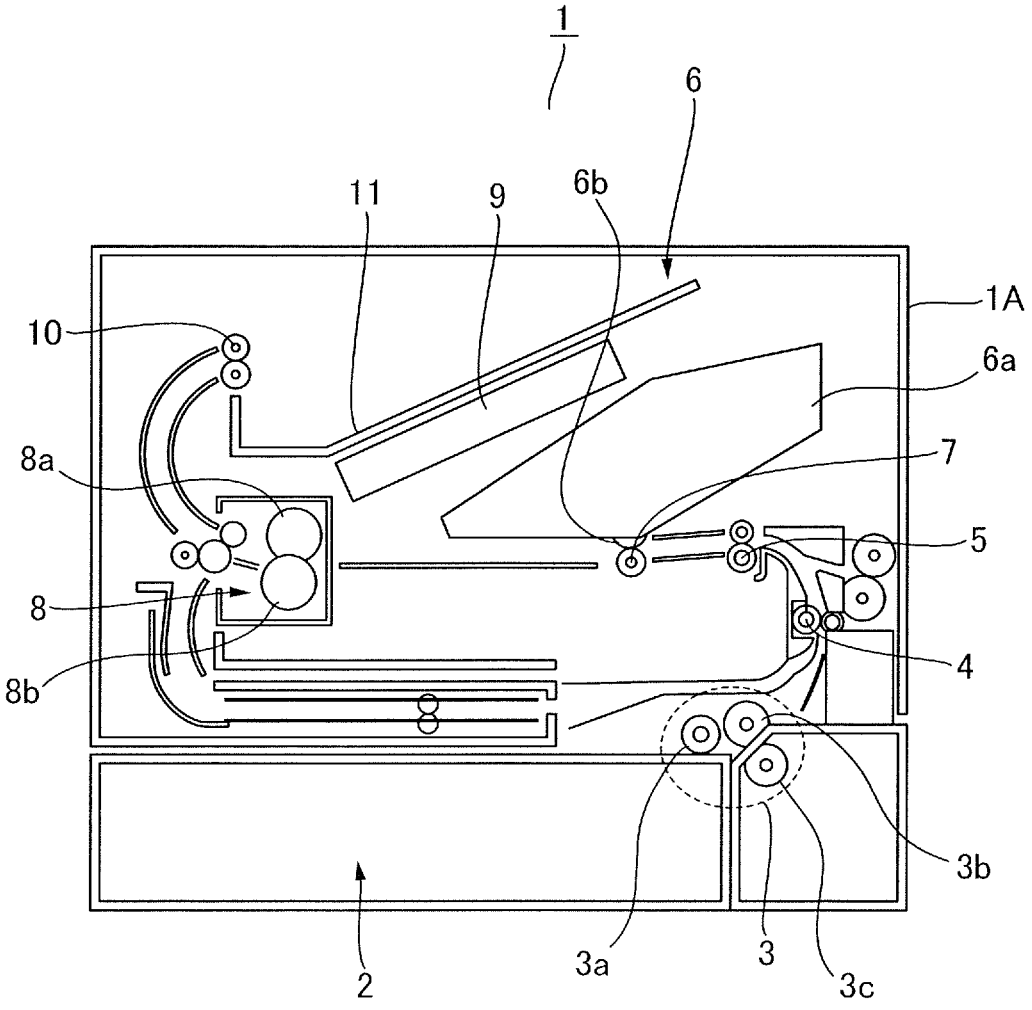
FIG. 1 is an overall schematic diagram of a printer according to a first embodiment.

First, a first embodiment of the present invention will be described. A printer 1 according to the first embodiment that serves as an image forming apparatus is an electrophotographic laser-beam printer. As illustrated in FIG. 1, the printer 1 includes a feeding cassette 2 provided such that the feeding cassette 2 can be inserted into and pulled out from a printer body 1A, a feeding portion 3, an image forming portion 6 that forms an image on a sheet fed by the feeding portion 3, a fixing portion 8, and a discharge roller pair 10.

When an image forming instruction is outputted to the printer 1, an image forming process by the image forming portion 6 is started, based on image information data inputted from, for example, an external computer connected to the printer 1 or an image reading apparatus optionally connected to the printer 1. The image forming portion 6 includes a known cartridge 6*a* including a photosensitive drum 6*b*, a charger, and a developing roller, a scanner unit 9, and a transfer roller 7.

The scanner unit 9 emits a laser beam to the photosensitive drum 6*b*, based on inputted image information data. At this time, the photosensitive drum 6*b* has been charged in advance by the charger, and thus an electrostatic latent image is formed on the photosensitive drum 6*b* by the laser beam projected thereto. The electrostatic latent image is then developed by the developing roller, and a toner image is formed on the photosensitive drum 6*b*.

Simultaneously with the above-described image forming process, a sheet that has been stuck on the feeding cassette 2 is fed by the feeding portion 3. The feeding portion 3 includes a pickup roller 3*a* that feeds sheets, stuck on the feeding cassette 2, and a feed roller 3*b* and a separation roller 3*c* that separate the sheets, one by one, fed by the pickup roller 3*a*. The sheet fed by the feeding portion 3 is conveyed to a registration roller pair 5 by a conveyance roller 4, and abuts a nip of the registration roller pair 5 that is in a stop state. The leading edge of the sheet then becomes parallel to the nip, and thus skew of the sheet is corrected.

The skew-corrected sheet is conveyed toward the transfer roller 7 by the registration roller pair 5, in synchronization with an image formation by the image forming portion 6. The transfer roller 7 is applied with transfer bias, and transfers the toner image formed on the photosensitive drum 6*b*, onto the sheet. The sheet, on which the toner image is transferred by the transfer roller 7, is then subjected to heat and pressure treatment by the fixing portion 8 constituted by a heating roller 8*a* and a pressure roller 8*b*, and thus the toner image is fixed on the sheet. The sheet on which the toner image is fixed is then discharged to a discharge tray 11 by the discharge roller pair 10.

Feeding Cassette

Figure 2:
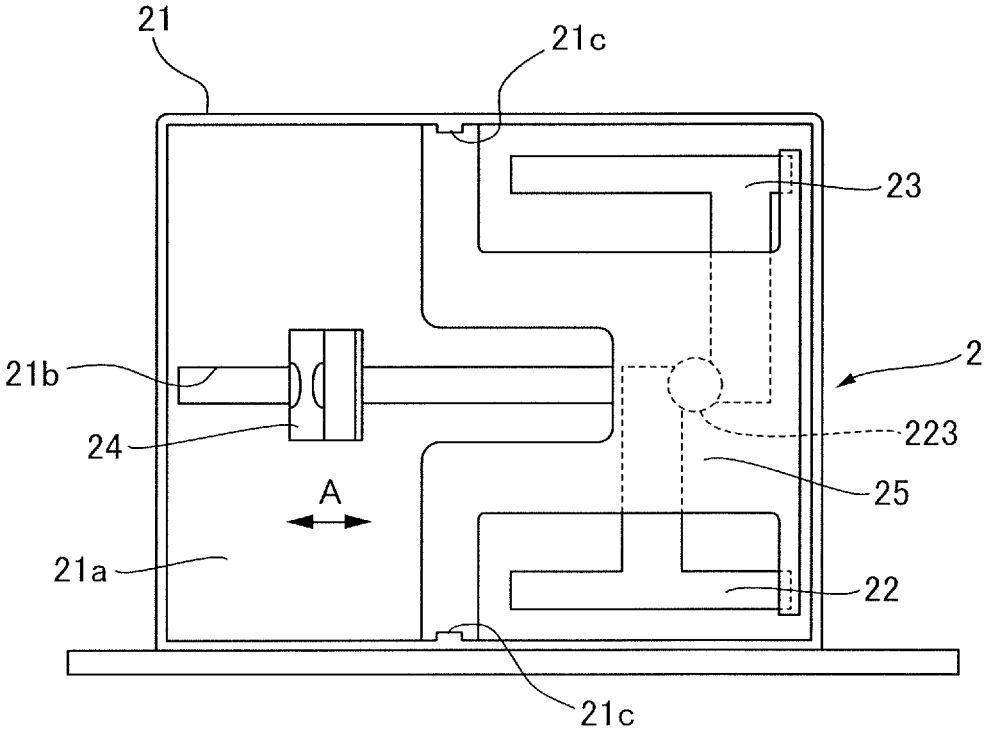
FIG. 2 is a plan view illustrating a feeding cassette.

Next, with reference to FIG. 2, a configuration of the feeding cassette 2 that serves as a sheet supporting apparatus will be described. The feeding cassette 2 includes a cassette body 21 including a base plate 21*a*, an intermediate plate 25 pivotally supported by the base plate 21*a*, side edge regulation plates 22 and 23, and a trailing edge regulation plate 24. The side edge regulation plates 22 and 23 regulate the positions of the side edges of sheets that are stuck on the base plate 21*a* and the intermediate plate 25, and the trailing edge regulation plate 24 regulates the position of the trailing edge of the sheets.

The side edge regulation plates 22 and 23 are supported such that the side edge regulation plates 22 and 23 can be moved in a width direction orthogonal to a sheet conveyance direction, and each have a rack-shaped portion which meshes with an interlocking gear 223. Thus, the side edge regulation plates 22 and 23 are structured such that, when the side edge regulation plate 22 is moved, the side edge regulation plate 23 is also moved together with the side edge regulation plate 22, with the aid of the interlocking gear 223 and the rack-shaped portions. The trailing edge regulation plate 24 is structured such that the trailing edge regulation plate 24 can be moved in the sheet conveyance direction and a direction opposite to the sheet conveyance direction (directions indicated by an arrow A) with the aid of a guide 21*b* formed in the base plate 21*a*.

The intermediate plate 25 is supported such that a downstream side, in the sheet conveyance direction, of the intermediate plate 25 is swung on the shaft portions 21*c* and 21*c*. When the downstream side of the intermediate plate 25 moves upward, a downstream side of the sheets stored in the feeding cassette 2 is pressed against the pickup roller 3*a*. The intermediate plate 25 is formed not to prevent the movements of the side edge regulation plates 22 and 23 and the trailing edge regulation plate 24 in the whole locus of the swing of the intermediate plate 25.

Structure of Trailing Edge Regulation Plate

Figure 3:
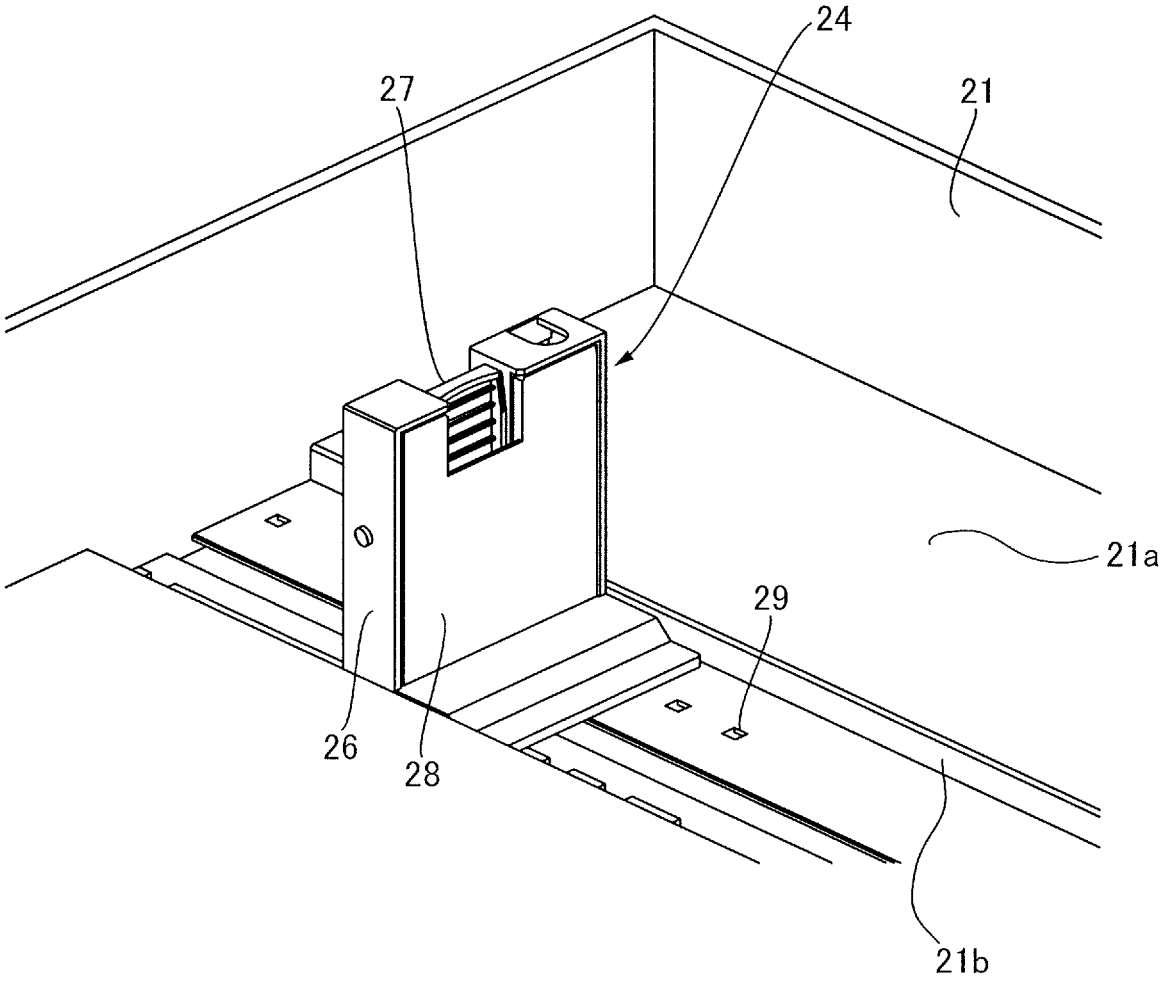
FIG. 3 is an overall perspective view illustrating a trailing edge regulation plate.

Next, a structure of the trailing edge regulation plate 24 of the first embodiment will be described in detail with reference to FIGS. 3 to 5. As illustrated in FIG. 3, the trailing edge regulation plate 24 that serves as a regulation unit includes a box-shaped body portion 26, a plate portion 28 capable of regulating the position of the trailing edge of the sheets that are stuck on the base plate 21*a*, and a lever portion 27. The plate portion 28 is structured such that the plate portion 28 can be slightly moved in the sheet conveyance direction, so that the plate portion 28 tolerates slight variations in sheet size produced in, for example, a cutting process. The base plate 21*a* that serves as a supporting portion of the feeding cassette 2 is provided with a plurality of positioning holes 29 at positions corresponding to standard sizes, such as A4 and B5.

Figure 4A:
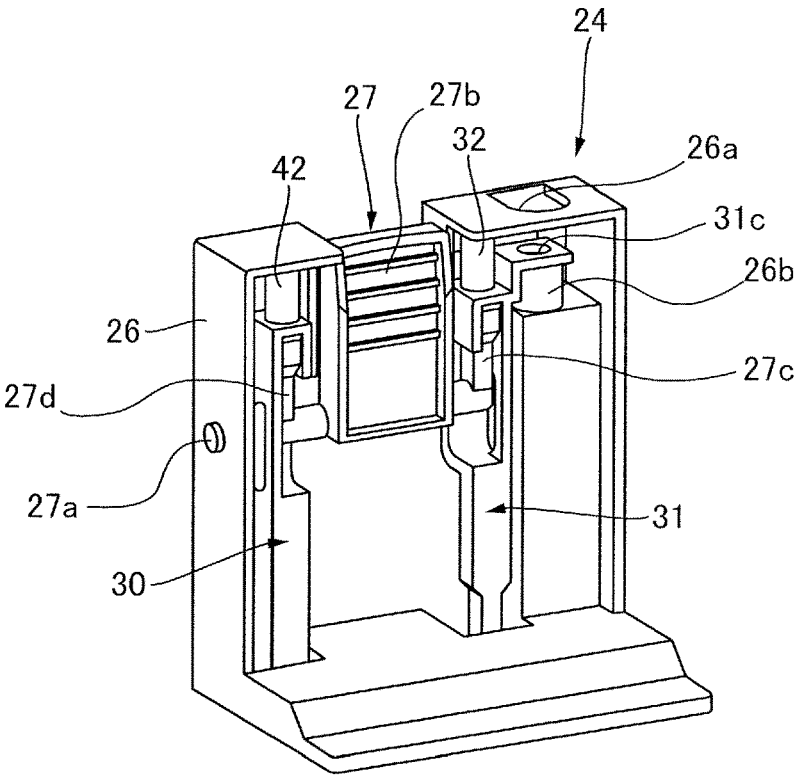
FIG. 4A is a perspective view illustrating an internal structure of the trailing edge regulation plate.
Figure 4B:
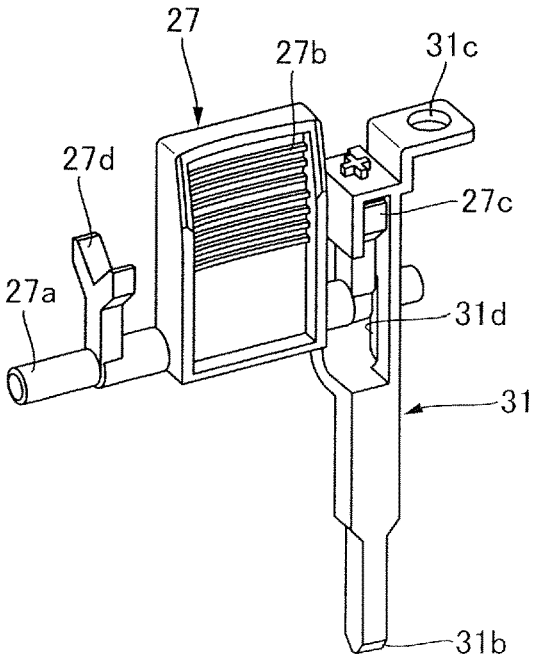
FIG. 4B is a perspective view illustrating a lever portion and a first stopper.

As illustrated in FIGS. 4A and 4B, a pivot shaft 27*a* of the lever portion 27, a first stopper 31, a second stopper 30 and the like are disposed inside the body portion 26. The lever portion 27 that serves as an operation portion includes the pivot shaft 27*a* pivotally supported by the body portion 26, a holding portion 27*b* integrated with the pivot shaft 27*a*, a first pressing portion 27*c*, and a second pressing portion 27*d*. The first pressing portion 27*c* and the second pressing portion 27*d* are pivoted with the holding portion 27*b* by a user pivoting the holding portion 27*b*.

In the present embodiment, the first stopper 31 is disposed corresponding to the first pressing portion 27*c*, and the second stopper 30 is disposed corresponding to the second pressing portion 27*d*. The structure of the first stopper 31 is substantially the same as that of the second stopper 30, and thus the first stopper 31 will be mainly described. Here, the first stopper 31 is a stopper to position the trailing edge regulation plate 24 at a position corresponding to any one of the standard sizes, and the second stopper 30 is a stopper to position the trailing edge regulation plate 24 at a position corresponding to a non-standard size. In FIG. 4B, the second stopper 30 is omitted.

As illustrated in FIG. 4B, the first stopper 31 that serves as an engagement portion is elongated in a vertical direction, and includes an engagement pin 31*b* formed at a lower end of the first stopper 31 and a long hole 31*d* formed at a substantially central portion of the first stopper 31. The long hole 31*d* is elongated in the vertical direction, and the pivot shaft 27*a* of the lever portion 27 passes through the long hole 31*d*. The first stopper 31 can be moved vertically between an engagement position at which the engagement pin 31*b* engages with the positioning hole 29 and a separation position at which the engagement pin 31*b* is separated upward from the positioning hole 29, in a range in which the long hole 31*d* can be moved with respect to the pivot shaft 27*a*.

At an upper end of the first stopper 31, a through hole 31*c* is formed at a position corresponding to a through hole 26*a* formed in the body portion 26, as illustrated in FIG. 4A. A female screw 26*b* is provided at a position corresponding to the through hole 26*a* of the body portion 26, and thus the first stopper 31 can be fixed at the engagement position by passing a screw 33 (see FIGS. 6A and 6B) through the through hole 31*c* of the first stopper 31 and by fixing the screw 33 to the female screw 26*b*. The screw 33 and the female screw 26*b* that serve as fixing components constitute a regulation portion 75 that can regulate movement of the first stopper 31 with respect to the body portion 26. A coil spring 32 is provided in a contracted state between the first stopper 31 and the body portion 26 of the trailing edge regulation plate 24, and thus the first stopper 31 is urged toward the engagement position by the coil spring 32 that serves as an urging portion.

Figure 5A:
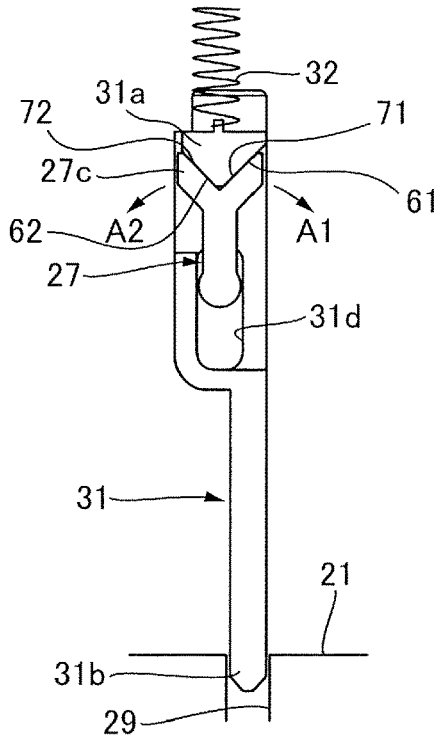
FIG. 5A is a side view illustrating the first stopper positioned at an engagement position.
Figure 5B:
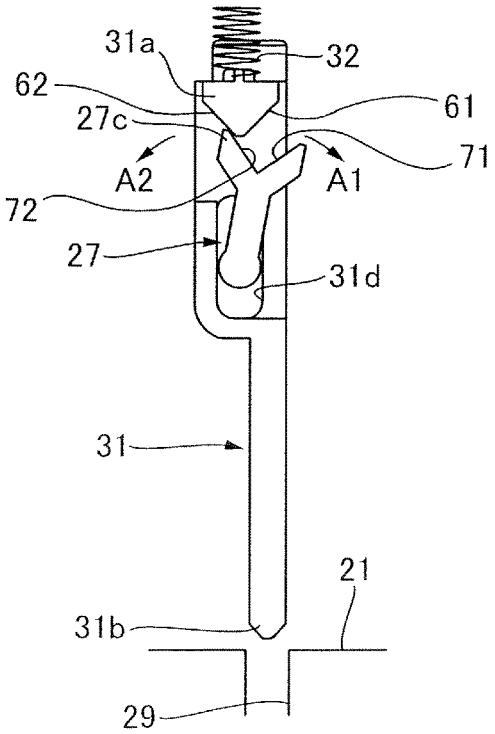
FIG. 5B is a side view illustrating the first stopper positioned at a separation position.

In addition, the first stopper 31 also includes a pressed portion 31*a* in contact with the first pressing portion 27*c*, as illustrated in FIGS. 5A and 5B. The pressed portion 31*a* is formed in a downward-projecting mountain shape, and has inclined surfaces 61 and 62 on a downstream side and an upstream side, respectively, in the sheet conveyance direction. An end of the first pressing portion 27*c* is formed in a downward-concave valley shape, corresponding to the form of the pressed portion 31*a*, and has inclined surfaces 71 and 72 on the downstream side and the upstream side, respectively, in the sheet conveyance direction. Here, a coil spring 42 is also provided in a contracted state between the second stopper 30 and the body portion 26 of the trailing edge regulation plate 24, and the second stopper 30 also includes a pressed portion having the same shape as that of the pressed portion of the first stopper 31.

Operation of Trailing Edge Regulation Plate

Next, the operation of the trailing edge regulation plate 24 will be described. In a case where a user sets sheets in the feeding cassette 2, the user first places sheets, such as sheets with a predetermined size, on the base plate 21*a* and the intermediate plate 25, and then positions the side edge regulation plates 22 and 23 by moving the side edge regulation plates 22 and 23 to the side edges of the sheets. In the present embodiment, the above-described predetermined size of the sheets is a standard size.

The user then operates the holding portion 27*b* and moves the trailing edge regulation plate 24. In a state of the trailing edge regulation plate 24 before the user operates the trailing edge regulation plate 24, the first stopper 31 and the second stopper 30 are urged toward the base plate 21*a* of the cassette body 21 by the urging force of the coil springs 32 and 42. When the trailing edge regulation plate 24 is positioned at a position corresponding to the standard-size sheets, the trailing edge regulation plate 24 is positioned by the first stopper 31 engaging with the positioning hole 29. When the trailing edge regulation plate 24 is not positioned at the position corresponding to the standard-size sheets, the trailing edge regulation plate 24 is positioned such that a plurality of teeth formed at an end of the second stopper 30 engage with a rack-shaped portion formed on the cassette body 21 of the feeding cassette 2.

When the holding portion 27*b* is pivoted upstream or downstream in the sheet conveyance direction from a neutral position, the first pressing portion 27*c* and the second pressing portion 27*d*, which are pivoted with the holding portion 27*b*, are pivoted in a direction indicated by an arrow A1 or a direction indicated by an arrow A2, as illustrated in FIG. 5B. Then, the first pressing portion 27*c* presses against the inclined surfaces 61 and 62 of the pressed portion 31*a* of the first stopper 31 and the second pressing portion 27*d* presses against the pressed portion of the second stopper 30. That is, the first pressing portion 27*c* and the second pressing portion 27*d* are formed so that the first pressing portion 27*c* and the second pressing portion 27*d* can lift the first stopper 31 and the second stopper 30 regardless of whether the holding portion 27*b* is pivoted to the upstream side or the downstream side in the sheet conveyance direction, from the neutral position. With this, the first stopper 31 and the second stopper 30 enter a state where the first stopper 31 and the second stopper 30 are separated upward from the base plate 21*a* of the cassette body 21 against the urging force of the coil springs 32 and 42, and where the trailing edge regulation plate 24 can be moved. In this state, the user moves the trailing edge regulation plate 24 in the sheet conveyance direction or the opposite direction, and positions the trailing edge regulation plate at a position corresponding to the above-described predetermined-size sheets.

When the movement of the trailing edge regulation plate 24 is completed, the user returns the holding portion 27*b* to its original position and engages the engagement pin 31*b* of the first stopper 31 with the positioning hole 29. That is, the first stopper 31 is positioned at the engagement position. With this, the trailing edge regulation plate 24 is positioned.

Commonly, when predetermined-size sheets are successively used, the trailing edge regulation plate 24 needs not to be moved. For that reason, it is preferable that the trailing edge regulation plate 24 is fixed not to be moved, when the sheet size is not changed, and that the fixed state of the trailing edge regulation plate 24 can be released only when the sheet size is changed.

Figure 6A:
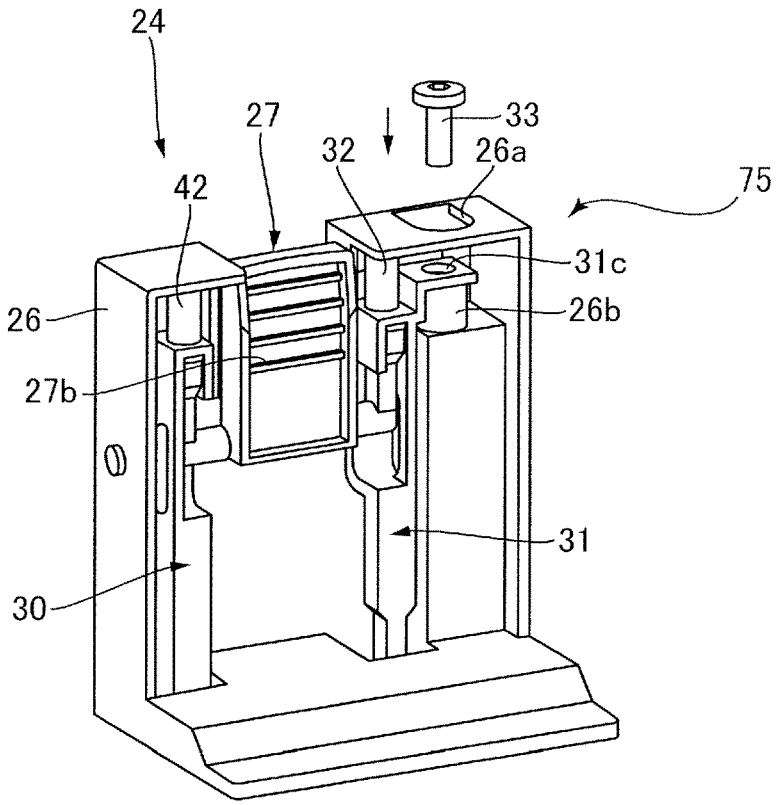
FIG. 6A is a perspective view illustrating a state where the first stopper is not fixed with a screw.
Figure 6B:
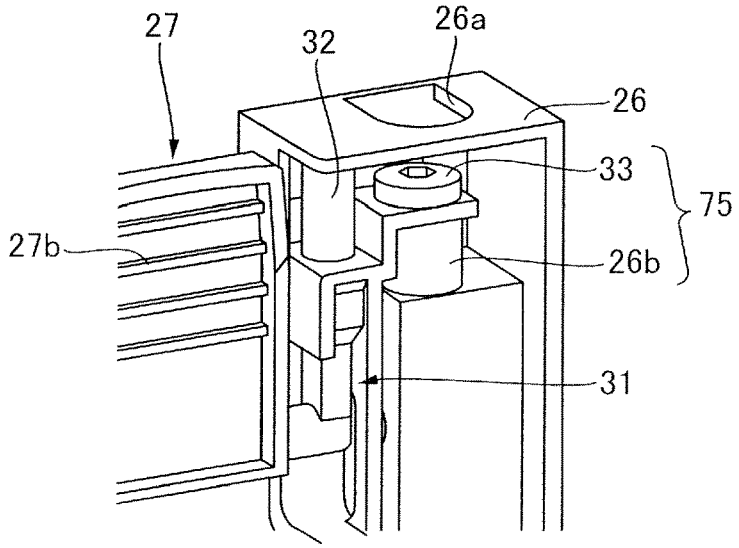
FIG. 6B is a perspective view illustrating a state where the first stopper is fixed with the screw.

In the present embodiment, the first stopper 31 positioned at the engagement position can be fixed to the female screw 26*b* of the body portion 26 with the screw 33, as illustrated in FIGS. 6A and 6B. More specifically, a user passes the screw 33 through the through hole 26*a* of the body portion 26, and through the through hole 31*c* of the first stopper 31. The user then screw-fits the screw 33 to the female screw 26*b*, and thereby can fix the first stopper 31 to the body portion 26, at the engagement position. That is, the first stopper 31 is positioned by the screw 33 with respect to the female screw 26*b* of the body portion 26 so that the first stopper 31 is retained at the engagement position. In this state, a user cannot move the holding portion 27*b*, and thus the trailing edge regulation plate 24 is fixed.

Thus, since the positional displacement of the trailing edge regulation plate 24 can be prevented by reliably fixing the trailing edge regulation plate 24 with respect to the base plate 21*a* of the cassette body 21, print precision can be improved and the occurrence of jam can be reduced. In addition, fixing the first stopper 31 with respect to the body portion 26 by the screw can achieve simplification, downsizing, and cost reduction of the sheet supporting apparatus, compared to a configuration in which a plurality of female screws are disposed at, for example, positions corresponding to standard sizes of sheets in the feeding cassette 2.

In addition, when the sheet size is often changed, the trailing edge regulation plate 24 is used without the screw 33 that fixes the trailing edge regulation plate 24. This can improve usability.

In addition, although the first stopper 31 is fixed at the engagement position with the screw 33 and the female screw 26*b* in the present embodiment, other fixing methods may be employed. For example, the first stopper 31 may be fixed to the body portion 26 with another fixing component, such as a snap ring.

Second Embodiment

Next, a second embodiment of the present invention will be described. In the second embodiment, the first stopper 31 of the first embodiment can be fixed by another configuration. Thus, the same component as that of the first embodiment is omitted in the drawings, or described with the same symbol given to the drawings.

Figure 7A:
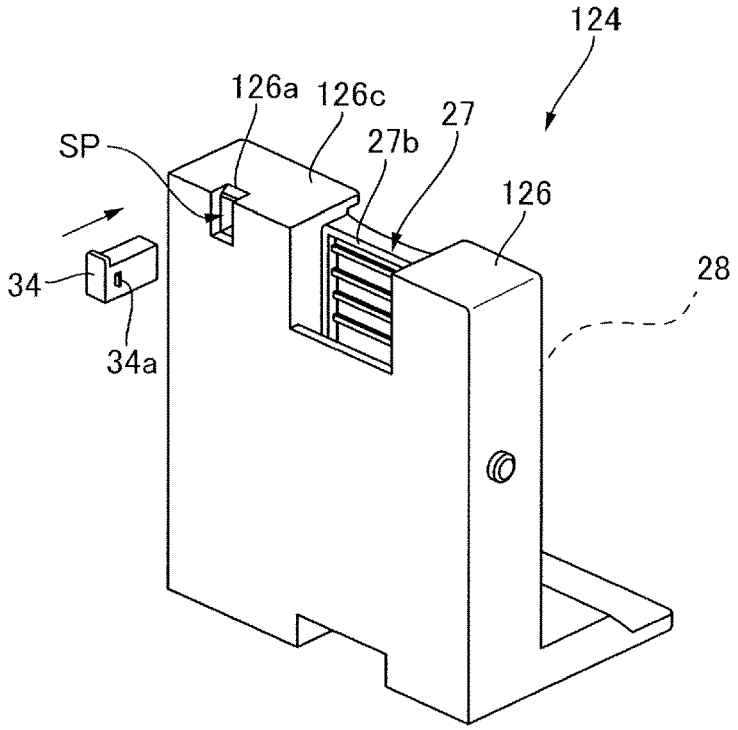
FIG. 7A is an overall perspective view illustrating a trailing edge regulation plate of a second embodiment.
Figure 7B:
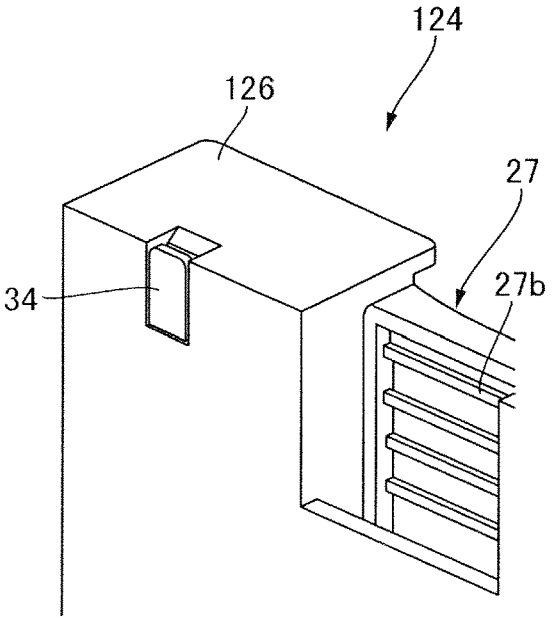
FIG. 7B is a rear perspective view illustrating a state where a spacer is attached.
Figure 7C:
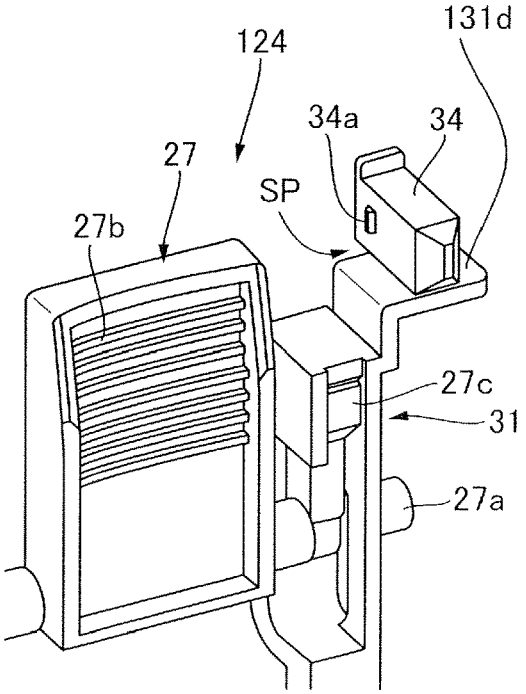
FIG. 7C is a front perspective view illustrating the state where the spacer is attached.

As illustrated in FIGS. 7A and 7B, a trailing edge regulation plate 124 includes a box-shaped body portion 126, the plate portion 28, the lever portion 27, and a spacer 34 that serves as a regulation portion. The body portion 126 is provided with an insertion hole 126*a* formed in a portion of the body portion 126 opposite to the plate portion 28, and the spacer 34 can be inserted into the insertion hole 126*a*. The spacer 34 is formed in a snap-fit structure. In this structure, the spacer 34 can be held by the body portion 126 by a projection 34*a* of the spacer 34 engaging with the body portion 126, and can be elastically deformed when pulled out.

Here, the first stopper 31 is positioned at the engagement position such that a predetermined gap SP is present between a top surface 131*d* of the first stopper 31 and a top plate 126*c* of the body portion 126, and is moved from the engagement position toward the separation position so as to reduce the gap SP. When a user fixes the trailing edge regulation plate 124, the user first positions the first stopper 31 at the engagement position and then inserts the spacer 34 into the insertion hole 126*a* of the body portion 126. With this configuration, the above-described gap SP between the first stopper 31 and the body portion 126 is filled with the spacer 34.

That is, the spacer 34 is placed in the gap SP, and thereby regulates the movement of the first stopper 31 from the engagement position to the separation position. Thus, because the first stopper 31 is fixed with respect to the body portion 126 so that the first stopper 31 is retained at the engagement position, and because the positional displacement of the trailing edge regulation plate 24 can be prevented, print precision can be improved and the occurrence of jam can be reduced. In addition, because the spacer 34 can be attached and detached without using any tool, fixing and releasing the trailing edge regulation plate 124 can be easily performed, and thus usability can be further improved.

The fixing of the trailing edge regulation plate with the spacer 34 in the present embodiment may be combined with the fixing of the trailing edge regulation plate with the screw 33 in the first embodiment, to achieve a configuration in which the trailing edge regulation plate can be fixed by using any method of spacer fixing and screw fixing. With this, usability can be improved.

Third Embodiment

Next, a third embodiment of the present invention will be described. In the third embodiment, the first stopper 31 of the first or the second embodiment can be fixed by another configuration. Thus, the same component as that of the first or the second embodiment is omitted in the drawings, or described with the same symbol given to the drawings.

Figure 8A:
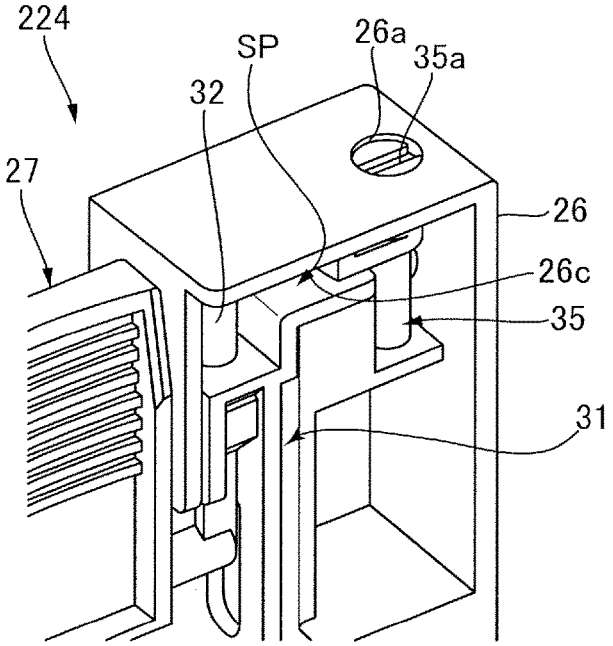
FIG. 8A is an overall perspective view illustrating a trailing edge regulation plate of a third embodiment.
Figure 8B:
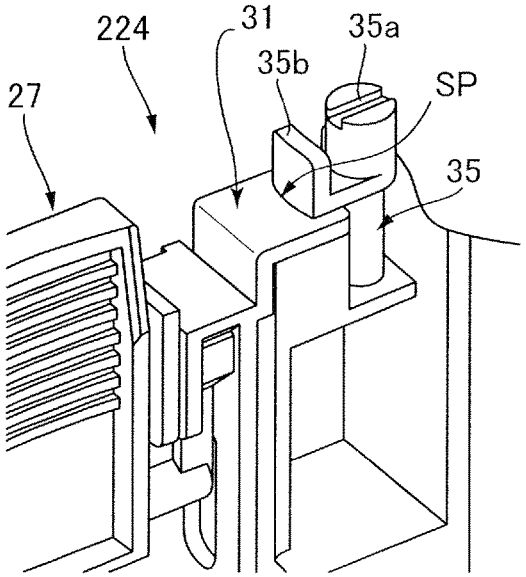
FIG. 8B is a front perspective view illustrating a state where a lock lever is positioned at a first position.
Figure 8C:
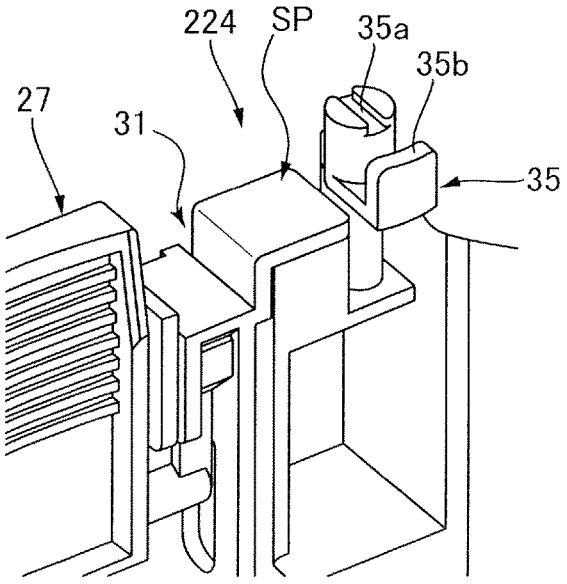
FIG. 8C is a front perspective view illustrating a state where the lock lever is positioned at a second position.

As illustrated in FIGS. 8A, 8B, and 8C, a lock lever 35 that serves as a moving member and a regulation portion is supported by the body portion 26 of a trailing edge regulation plate 224 such that the lock lever 35 can pivot on an axis extending in a vertical direction. The vertical direction serves as a second direction that is a moving direction of the first stopper 31. Here, the trailing edge regulation plate 224 can be moved in the sheet conveyance direction that serves as a first direction orthogonal to the vertical direction. At the upper end of the lock lever 35, a concave portion 35*a* is formed which can be accessed by using, for example, a tool. The lock lever 35 is pivoted between a first position illustrated in FIG. 8B and a second position illustrated in FIG. 8C, by a user operating the concave portion 35*a*. The lock lever 35 includes a lock portion 35*b* extending from a center of the shaft of the lock lever 35 toward a radial direction of the shaft. When the lock lever 35 is positioned at the first position, the lock portion 35*b* is positioned between the first stopper 31 and the top plate 26*c* of the body portion 26.

When a user fixes the trailing edge regulation plate 224 with respect to the cassette body 21 (see FIG. 2), the user positions the first stopper 31 at the engagement position and positions the lock lever 35 at the first position, as illustrated in FIG. 8B. With this configuration, the lock portion 35*b* of the lock lever 35 enters the gap SP between the first stopper 31 and the top plate 26*c* of the body portion 26. The lock portion 35*b* interfere with the first stopper 31 when the first stopper 31 moves from the engagement position toward the separation position, thus regulating the movement of the first stopper 31. That is, the first stopper 31 is positioned with the lock portion 35*b* with respect to the body portion 26 so that the first stopper 31 is retained at the engagement position.

In order to move the trailing edge regulation plate 224 with respect to the cassette body 21, a user operates the concave portion 35*a* through the through hole 26*a* (see FIG. 8A) of the body portion 26 to position the lock lever 35 at the second position, as illustrated in FIG. 8C. With this configuration, the lock portion 35*b* of the lock lever 35 is separated away from the gap SP between the first stopper 31 and the top plate 26*c* of the body portion 26, and allows the first stopper 31 to move from the engagement position to the separation position.

Thus, fixing and releasing of the trailing edge regulation plate 124 to and from the body portion 26 can be easily performed without providing any additional member. This improves usability. In addition, the form of the concave portion 35*a* may be modified as appropriate to pivot the lock lever 35 by using only a dedicated tool. With this configuration, specific and limited users can fix or release the trailing edge regulation plate 224.

Although the present invention is applied, in any of the embodiments described above, to the trailing edge regulation plate that regulates the position of the trailing edge of the sheets, the present invention is not limited to this. For example, the present invention may be applied to the side edge regulation plates 22 and 23 that regulate the positions of the side edges of the sheets.

Also, although the description is made, in any of the embodiments describe above, for the case where the electrophotographic printer 1 is used, the present invention is not limited to this. For example, the present invention may also be applied to an ink-jet image forming apparatus that forms images on sheets by injecting ink from a nozzle.

Also, although the description is made, in any of the embodiments described above, for the configuration in which the first stopper 31 is locked at the engagement position, the present invention is not limited to this. For example, the first stopper 31 may be locked at a position between the engagement position and the separation position as long as the first stopper 31 is not pulled out of the positioning hole 29.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-152178, filed Aug. 2, 2016, which is hereby incorporated by reference herein in its entirety.

What is claimed is:

1. A sheet supporting apparatus, comprising:

a cassette body configured to support a sheet;

a regulation device disposed on the cassette body to be movable in a moving direction, and configured to regulate a position of an edge of the sheet; and a plurality of engaged portions disposed on the cassette body in the moving direction, wherein the regulation device comprises:

a body portion;

an engaging portion configured to move between an engagement position at which the engaging portion engages with one of the plurality of engaged portions and a separation position at which the engaging portion is separated from the plurality of engaged portions;

an urging portion configured to urge the engaging portion toward the engagement position; and an operation member pivotably supported on the body portion and configured to be operated between a first posture at which the operation member positions the engaging portion at the engagement position and a second posture at which the operation member positions the engaging portion at the separation position, wherein the body portion defines an opening through which a retention component inserts the retention component retaining the operation member at the first posture in a state where the retention component inserted through the opening is mounted on the body portion.

2. The sheet supporting apparatus according to claim 1, wherein the retention component comprises a fixing component configured to fix the engaging portion positioned at the engagement position to the body portion.

3. The sheet supporting apparatus according to claim 2, wherein the fixing component comprises a screw, and the body portion comprises a female screw to which the screw is screw-fitted.

4. The sheet supporting apparatus according to claim 1, wherein the engaging portion is disposed apart from the body portion with a gap at the engagement position, and is configured to move from the engagement position toward the separation position while the gap is reduced, the retention component comprises a spacer configured to be detachably placed in the body portion, and the spacer is configured to regulate movement of the engaging portion from the engagement position to the separation position in a state of being inserted into the gap.

5. The sheet supporting apparatus according to claim 1, wherein the operation member comprises a pressing portion configured to press the engaging portion from the engagement position to the separation position by the operation member being pivoted.

6. The sheet supporting apparatus according to claim 5, wherein the pressing portion is configured to press the engaging portion from the engagement position toward the separation position regardless of whether the operation member is pivoted to one pivot direction or the other pivot direction, from the first posture.

7. The sheet supporting apparatus according to claim 1, wherein the retention component is configured to detach from the body through the opening while the operation member keeps at the first posture without moving from the first posture to the second posture.

8. The sheet supporting apparatus according to claim 1, wherein the cassette body defines holes, as the plurality of engaged portions, one of which the engaging portion positioned at the engagement position engages.

9. An image forming apparatus comprising:

the sheet supporting apparatus according to claim 1; and an image forming portion configured to form an image on a sheet fed from the sheet supporting apparatus.

10. A sheet supporting apparatus, comprising:

a cassette body configured to support a sheet;

a regulation device disposed on the cassette body to be movable in a moving direction, and configured to regulate a position of an edge of the sheet; and a plurality of engaged portions disposed on the cassette body in the moving direction, wherein the regulation device comprises:

a body portion;

an engaging portion configured to move between an engagement position at which the engaging portion engages with one of the plurality of engaged portions and a separation position at which the engaging portion is separated from the plurality of engaged portions; and an operation member pivotably supported on the body portion and configured to be operated between a first posture at which the operation member positions the engaging portion at the engagement position and a second posture at which the operation member positions the engaging portion at the separation position, wherein the body portion defines an opening through which a retention component inserts the retention component retaining the operation member at the first posture in a state where the retention component inserted through the opening is mounted on the body portion, and the retention component is configured to detach from the body through the opening while the operation member stays at the first posture without moving from the first posture to the second posture.

* * * * *